US007565989B2

(12) United States Patent
Lai et al.

(10) Patent No.: US 7,565,989 B2
(45) Date of Patent: Jul. 28, 2009

(54) HOOK DEVICE FOR A NAILER

(75) Inventors: Chun-Chih Lai, Taichung (TW); Jian-Rung Wu, Taichung (TW)

(73) Assignee: Basso Industry Corp., Shi Tun Dist., Taichung (TW)

( * ) Notice: Subject to any disclaimer, the term of this patent is extended or adjusted under 35 U.S.C. 154(b) by 747 days.

(21) Appl. No.: 10/968,559

(22) Filed: Oct. 19, 2004

(65) Prior Publication Data

US 2006/0081667 A1 Apr. 20, 2006

(51) Int. Cl.
*A45F 5/00* (2006.01)
*A45F 3/02* (2006.01)

(52) U.S. Cl. ..... 224/269; 224/268; 224/270; 224/621; 224/618

(58) Field of Classification Search ..... 224/269, 224/268, 270, 621, 618; 173/168, 170, 171; 227/156; 248/301
See application file for complete search history.

(56) References Cited

U.S. PATENT DOCUMENTS 6,679,406 B2 * 1/2004 Sakai et al. ..... 224/269
2003/0141330 A1 * 7/2003 McDonald et al. ..... 224/242

* cited by examiner

*Primary Examiner*—Nathan J. Newhouse
*Assistant Examiner*—Lester L. Vanterpool
(74) *Attorney, Agent, or Firm*—Charles E. Baxley

(57) ABSTRACT

The present invention relates to a hook device which can be firmly positioned on a nailer, wherein a fastener is used to insert in the rear plug by cooperating with a ring-like hook, so as to make the rear plug slightly bulge out to press against the ring-like hook, thus, the ring-like hook is firmly fixed to the rear plug. The hook device can be arbitrarily and rotatably positioned on the nailer, wherein a plurality of positioning grooves are formed on the step circular wall of the rear plug, and a ring-like hook is mounted on the rear plug. The ring-like hook is provided with a positioning unit which is to be engaged in the positioning grooves of the rear plug, so as to enable the ring-like hook to be rotatably positioned on rear plug. Thereby, the user can position the nailer arbitrarily according to real needs.

6 Claims, 5 Drawing Sheets

HOOK DEVICE FOR A NAILER

BACKGROUND OF THE INVENTION

1. Field of the Invention

The present invention relates to a nailer, and more particularly to a hook device for a nailer.

2. Description of the Prior Arts

Most of the nailers are provided at the handle portion with a hook for hanging the nailer directly on the waist belt or on a predetermined position at the workplace. However, the hook device is unrotatably fixed to the conventional nailer, thus inconveniences will be caused for the user since the position of the nailer cannot be adjusted arbitrarily according to real needs.

The present invention has arisen to mitigate and/or obviate the afore-described disadvantages.

SUMMARY OF THE INVENTION

The primary-objective of the present invention is to provide a hook device for a nailer which can be firmly positioned on a nailer, wherein a fastener is used to insert in the rear plug by cooperating with a ring-like hook, so as to make the rear plug slightly bulge out to press against the ring-like hook, thus, the ring-like hook is firmly fixed to the rear plug.

The secondary objective of the present invention is to a hook device for a nailer which can be arbitrarily and rotatably positioned on the nailer, wherein a plurality of positioning grooves are formed on the step circular wall of the rear plug, and a ring-like hook is mounted on the rear plug. The ring-like hook is provided with a positioning unit which is to be engaged in the positioning grooves of the rear plug, so as to enable the ring-like hook to be rotatably positioned on rear plug. Thereby, the user can position the nailer arbitrarily according to real needs.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
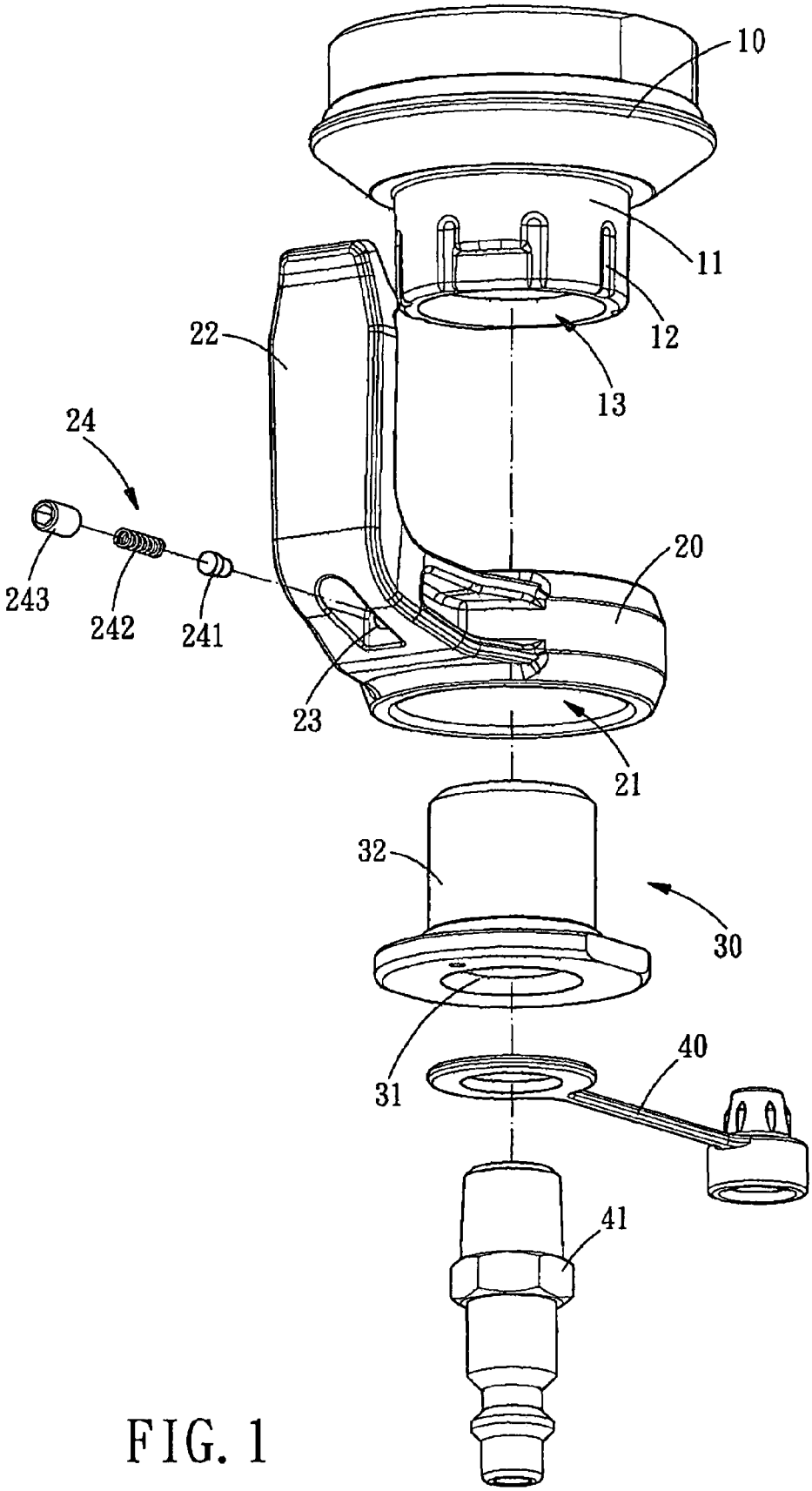
FIG. 1 is an exploded view of a hook device for a nailer in accordance with the present invention.
Figure 2:
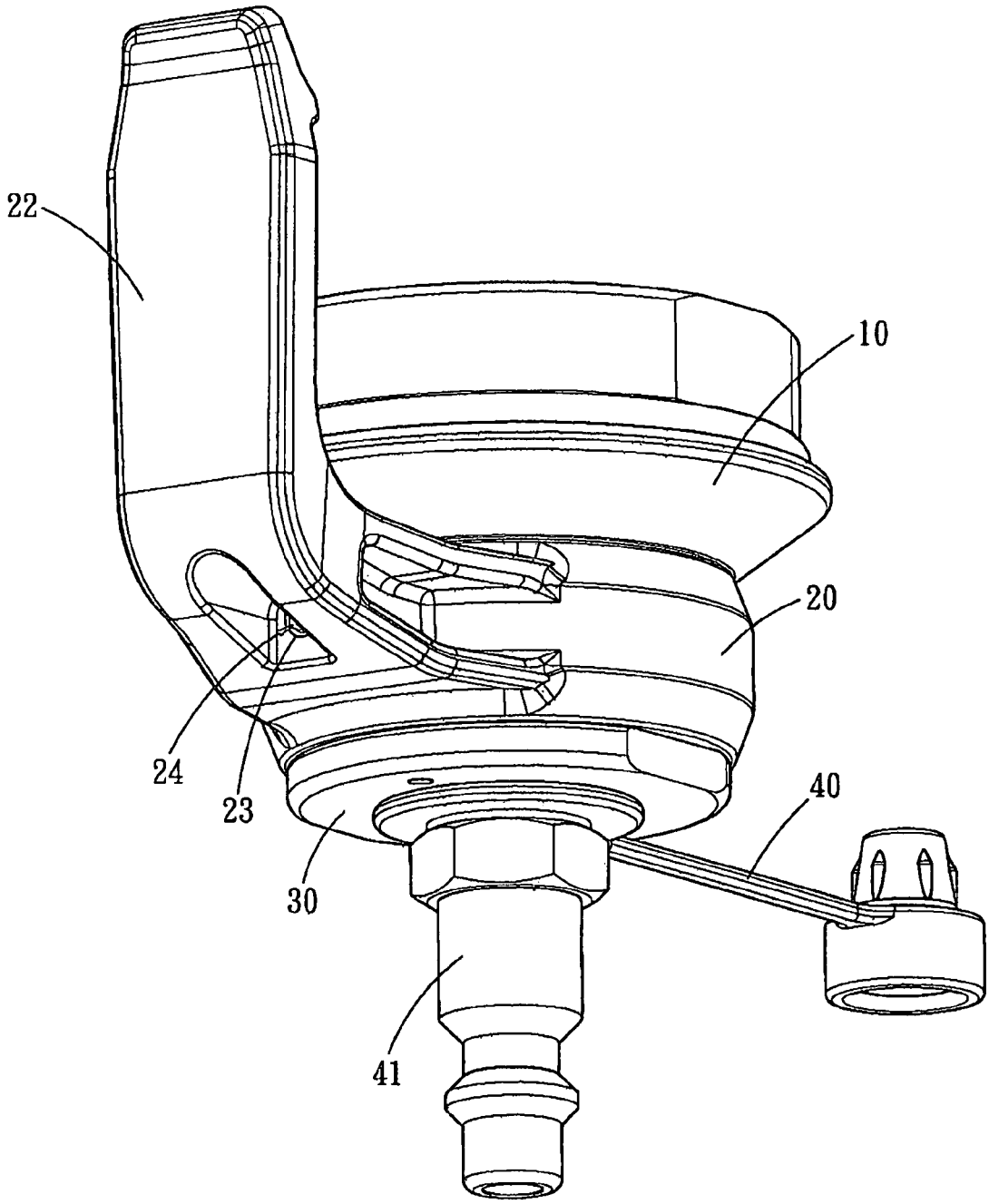
FIG. 2 is an assembly view of a hook device for a nailer in accordance with the present invention.

Referring to FIGS. 1-2, a hook device for a nailer in accordance with the present invention comprises: a rear plug 10, a ring-like hook 20, a fastener 30, a dust-proof member 40 and a quick coupler 41.

The rear plug 10 is assembled to a main body of the nailer and is interiorly formed with a through hole 13. At an end of the rear plug 10 is provided a step circular wall 11 on which is annularly defined a plurality of positioning grooves 12.

The ring-like hook 20 is provided with a receiving hole 21 in response to the step circular wall 11 of the rear plug 10, and provided with a hook structure 22 at a lateral side thereof. The hook structure 22 is defined with a positioning threaded hole 23 corresponding to the receiving hole 21. In the threaded hole 23 is disposed a positioning unit 24 including a pin 241, a spring 242 and a screw 243. The pin 241 and the spring 242 are sealed in the threaded hole 23 by the screw 243. The ring-like hook 20 is mounted onto the step circular wall 11 of the rear plug 10 through the receiving hole 21 in such a manner that the pin 241 is pushed by the spring 242 into one of the positioning grooves 12 on the step circular wall 11 of the rear plug 10.

The fastener 30 is formed with a connecting hole 31 and a step portion 32 which is employed to insert in the through hole 13 of the rear plug 10, and the step portion 32 will make the step circular wall 11 of the rear plug 10 slightly bulge out.

The dust-proof member 40 is annularly mounted on the outer periphery of the quick coupler 41, and then the quick coupler 41 is inserted in the connecting hole 31 of the fastener 30.

Figure 3:
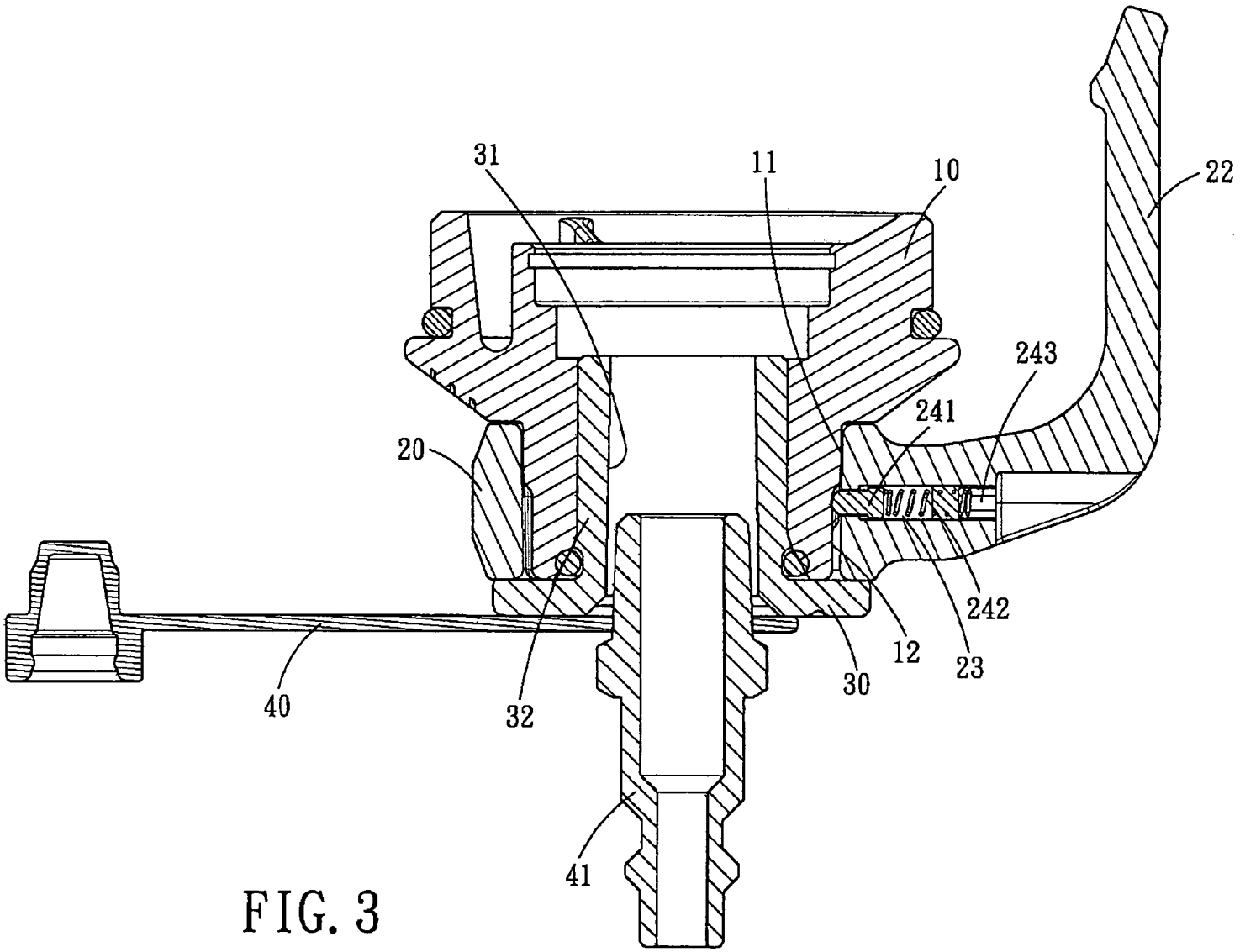
FIG. 3 is an assembly cross sectional view of a hook device for a nailer in accordance with the present invention.

Referring to FIG. 3, the fastener 30 is inserted in the through hole 13 of the rear plug 10, the step portion 32 of the fastener 30 makes the step circular wall 11 of the rear plug 10 bulge out slightly, and then the ring-like hook 20 is mounted on the step circular wall 11 of the rear plug 10. Thereby, ring-like hook 20 will be firmly but rotatably positioned on the step circular wall 11 after the step circular wall 11 bulges out.

On the other hand, since the pin 241 of the positioning unit 24 is pushed by the spring 242 into one of the positioning grooves 12 on the step circular wall 11 of the rear plug 10, the positioning unit 24 will cooperate with the respective positioning grooves 12 to position the ring-like hook 20 when it is rotated by the user. Thereby, the user is able to arbitrarily fix the hook 22 of the ring-like hook 20 at any desired angle.

Figure 4:
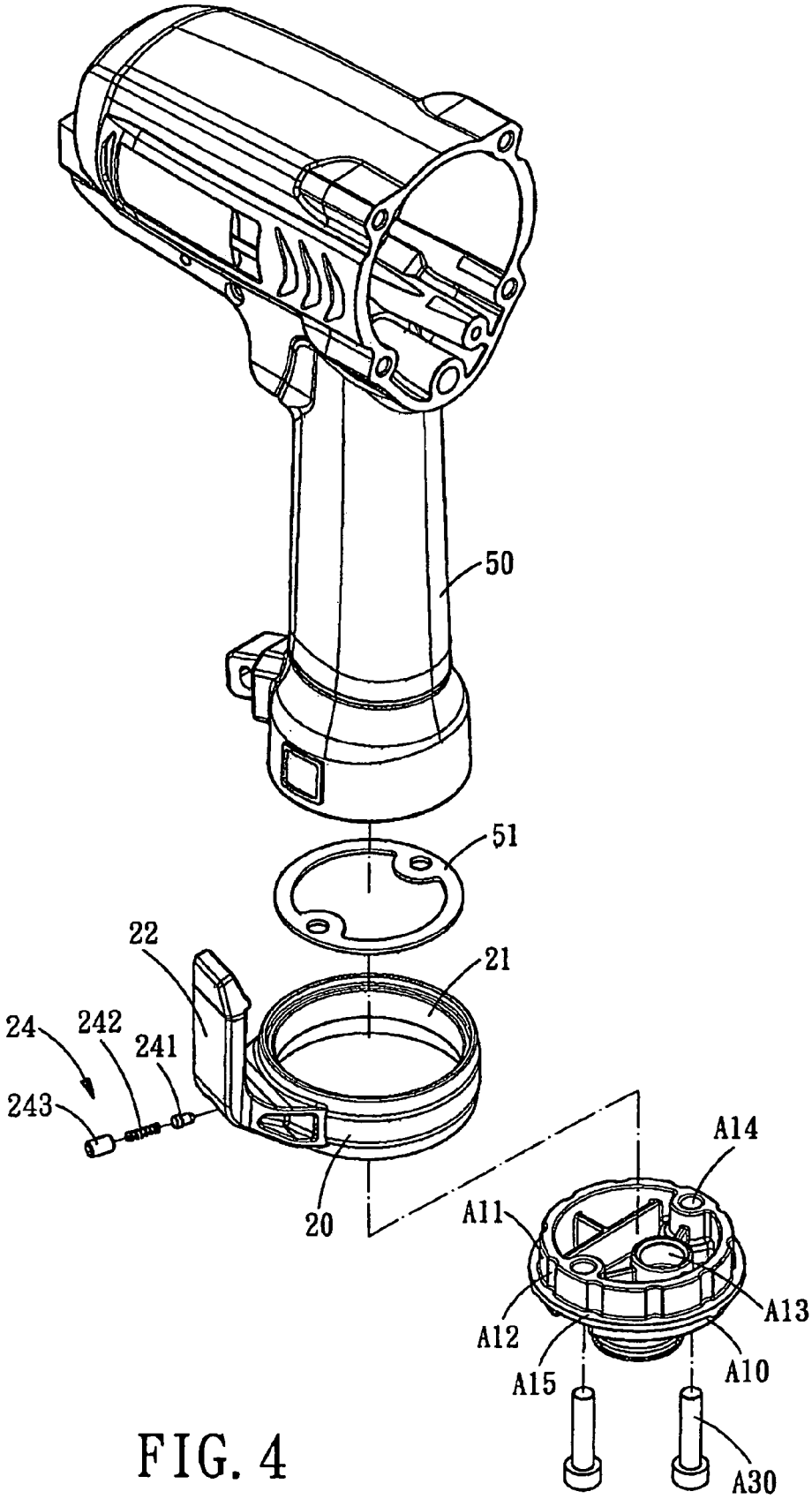
FIG. 4 is an exploded view of a hook device for a nailer in accordance with another embodiment of the present invention.
Figure 5:
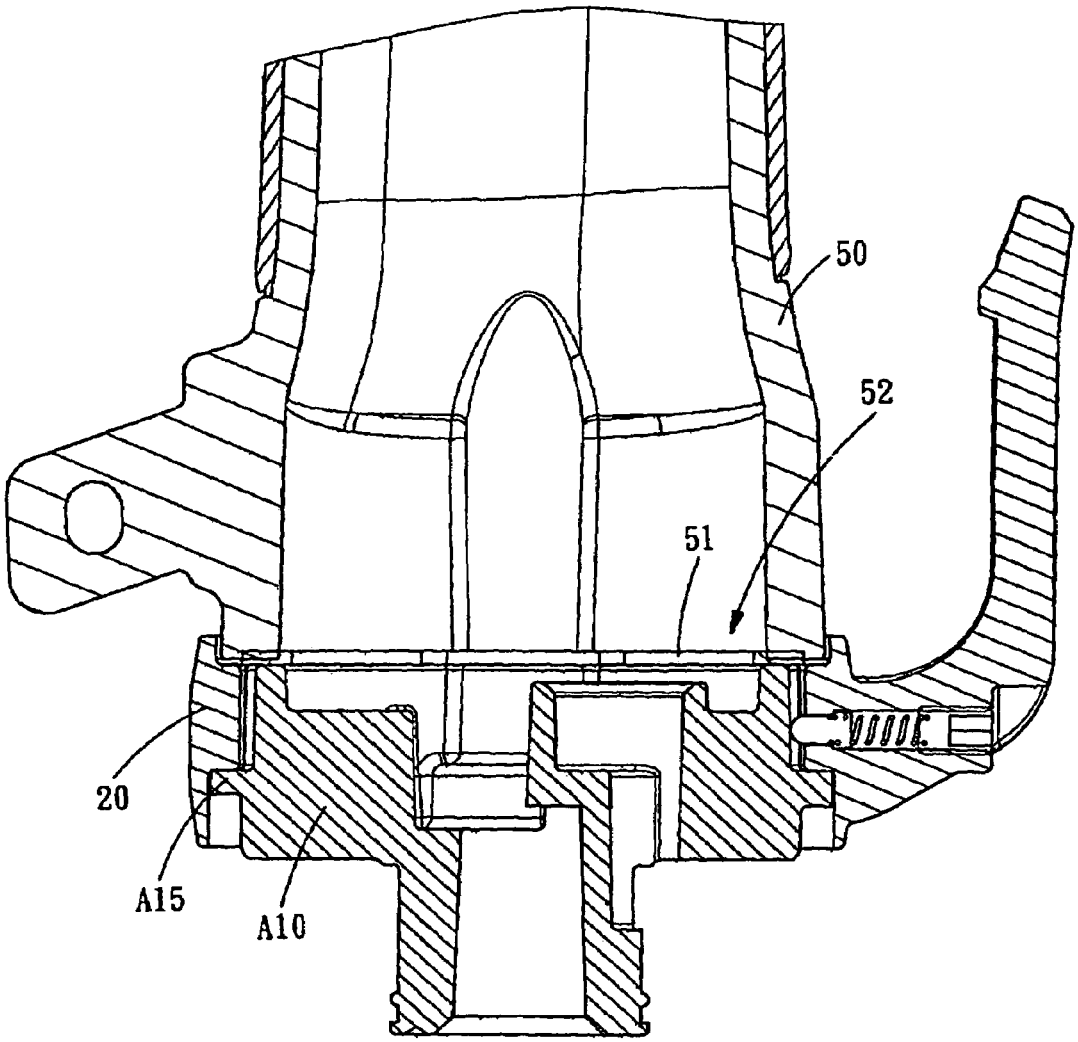
FIG. 5 is an assembly cross sectional view of a hook device for a nailer in accordance with another embodiment of the present invention.

Referring further to FIGS. 4 and 5, a hook device for a nailer in accordance with another embodiment of the present invention is shown and generally comprises: a main body of a nailer 50, a joint ring 51, a ring-like hook 20, a rear plug A10 and two fasteners A30.

The main body of a nailer 50 is defined at a bottom edge of the handle portion thereof with an inlet 52, and at a gate of the inlet 52 is disposed the joint ring 51.

The rear plug A10 is disposed at the inlet 52 of the main body of a nailer 50 and interiorly defined with a through hole A13 which is in communication with the inlet 52. At a side of the rear plug A10 is provided a step circular wall A11 facing towards the main body of a nailer 50, on the outer surface of the step circular wall A11 are annularly arranged a plurality of positioning grooves A12. A plurality of protrusions are integrally formed with the step circular wall A11, in each of the protrusions are formed a threaded hole A14 which is a certain distance away from the step circular wall A11. On the step circular wall A11 is annularly formed a flange A15 facing toward the main body of a nailer 50.

The ring-like hook 20 is provided with a receiving hole 21 in response to the step circular wall A11 of the rear plug A10, and is further provided at a lateral side thereof with a hook structure 22. The hook structure 22 is defined with a positioning threaded hole 23 corresponding to the receiving hole 21. In the threaded hole 23 is disposed a positioning unit 24 including a pin 241, a spring 242 and a screw 243. The pin 241 and the spring 242 are sealed in the threaded hole 23 by the screw 243. The ring-like hook 20 is mounted onto the step circular wall A11 of the rear plug 10 through the receiving hole 21 in such a manner that the pin 241 is pushed by the spring 242 into one of the positioning grooves A12 on the step circular wall A11 of the rear plug A10.

Two fasteners A30, in this embodiment, are two screws which are screwed in the threaded holes A14 of the rear plug A10, so as to make the step circular wall A11 of the rear plug A10 bulge out slightly.

The fasteners A30, in this embodiment, are inserted in the threaded holes A14 of the rear plug A10 to make the step circular wall A11 of the rear plug A10 bulge out slightly, and then the ring-like hook 20 is mounted on the step circular wall A11 of the rear plug A10. Thereby, ring-like hook 20 will be firmly but rotatably positioned on the step circular wall 11 after the step circular wall 11 bulges out. Since the positioning unit 24 in this embodiment is functionally and structurally the same as that of the first embodiment, further remarks on this matter would seem superfluous.

On the other hand, the step circular wall A11 of the rear plug A10 in this embodiment is provided at a lateral side thereof with a flange A15 facing towards the main body of a nailer 50, the flange A15 is used to abut against the ring-like hook 20 so as to fix the ring-like hook 20 to the main body of a nailer 50 more firmly. As disclosed by the drawings of the present invention, the longitudinal direction of the positioning grooves on the rear plug is parallel to the axial direction of the handle of the nailer. However, the positioning unit also can be alternatively disposed in the rear plug of the nailer, and the positioning grooves can be arranged on the fasteners, thus, the longitudinal direction of the positioning grooves is vertical to the axis of the handle of the nailer.

While we have shown and described various embodiments in accordance with the present invention, it should be clear to those skilled in the art that further embodiments may be made without departing from the scope of the present invention.

What is claimed is:

1. A hook device for a nailer comprising:

a ring-like hook mounted on a step circular wall of a rear plug of the nailer;

a plurality of positioning grooves formed on the step circular wall of the rear plug, the ring-like hook provided with a positioning unit in response to the positioning grooves on the rear plug;

a fastener disposed in the step circular wall of the rear plug and employed to fix the rear plug by cooperating with the ring-like hook;

the rear plug is assembled to a main body of the nailer and is interiorly formed with a through hole, at an end of the rear plug is provided a step circular wall on which are annularly defined the plurality of positioning grooves;

the ring-like hook is provided with the receiving hole in response to the step circular wall of the rear plug and provided with a hook structure at a lateral side thereof, the hook structure is provided with the positioning unit corresponding to the receiving hole, the positioning unit engages in one of the positioning grooves on the step circular wall of the rear plug;

the fastener is formed with a connecting hole and a step portion which is employed to insert in the through hole of the rear plug, and the step portion will make the step circular wall of the rear plug slightly bulge out;

the hook structure is defined with a positioning threaded hole in response to the receiving hole, the positioning unit includes a pin, a spring and a screw, the pin and the spring are sealed in the threaded hole by the screw in such a manner that the pin is pushed by the spring into one of the positioning grooves on the step circular wall of the rear plug.

2. A hook device for a nailer comprising a main body of the nailer, a joint ring, the ring-like hook, the rear plug and a plurality of fasteners, wherein:

the main body of the nailer is defined at a bottom edge of the handle portion thereof with an inlet, and at a gate of the inlet is disposed the joint ring;

the rear plug is disposed at the inlet of the main body of the nailer and interiorly defined with a through hole which is in communication with the inlet, at a side of the rear plug is provided a step circular wall facing towards the main body of a nailer, on an outer surface of the step circular wall are annularly arranged a plurality of positioning grooves, a plurality of protrusions are integrally formed with the step circular wall, in each of the protrusions is formed a threaded hole which is a certain distance away from the step circular wall;

the ring-like hook is provided with a receiving hole in response to the step circular wall of the rear plug and is further provided at a lateral side thereof with a hook structure, the hook structure is provided with a positioning unit corresponding to the receiving hole, the positioning unit engages in one of the positioning grooves on the step circular wall of the rear plug;

a plurality of fasteners are inserted in the rear plug, so as to make the step circular wall of the rear plug bulge out slightly.

3. The hook device for a nailer as claimed in claim 2, wherein the hook structure is defined with a positioning threaded hole in response to the receiving hole, the positioning unit includes a pin, a spring and a screw, the pin and the spring are sealed in the threaded hole by the screw in such a manner that the pin is pushed by the spring into one of the positioning grooves on the step circular wall of the rear plug.

4. The hook device for a nailer as claimed in claim 2, wherein the step circular wall of the rear plug in this embodiment is provided at a lateral side thereof with a flange facing towards the main body of a nailer, the flange serves to abut against the ring-like hook so as to fix the ring-like hook to the main body of a nailer.

5. The hook device for a nailer as claimed in claim 1, wherein a longitudinal direction of the positioning grooves on the rear plug is parallel to the axial direction of the handle of the nailer.

6. The hook device for a nailer as claimed in claim 1, wherein the positioning unit is disposed in the rear plug of the nailer, the positioning grooves are arranged on the fasteners, and the longitudinal direction of the positioning grooves is vertical to the axis of the handle of the nailer.

* * * * *